US005647415A

United States Patent [19]

Onders et al.

[11] Patent Number: 5,647,415

[45] Date of Patent: Jul. 15, 1997

[54] FUNNEL FOR A DRUM

[75] Inventors: James P. Onders, Independence; Darel Taylor, Chardon, both of Ohio

[73] Assignee: ENPAC Corporation, Chardon, Ohio

[21] Appl. No.: 540,842

[22] Filed: Oct. 11, 1995

[51] Int. Cl.[6] ..... B65B 1/04

[52] U.S. Cl. ..... 141/331; 141/341; 141/364

[58] Field of Search ..... 141/331, 332, 141/333, 334, 335, 336, 337, 338, 339, 340, 341, 342, 343, 344, 345, 346, 106, 98; 248/94; 184/106; 215/214, 218; 220/571, 571.1, 661

[56] References Cited

U.S. PATENT DOCUMENTS

| | | | |
|---|---|---|---|
| 4,094,432 | 6/1978 | Zilbert | 220/661 |
| 4,112,984 | 9/1978 | Guglia et al. | 141/339 |
| 4,702,290 | 10/1987 | Perez | 141/332 |
| 5,018,559 | 5/1991 | Branan | 141/331 |
| 5,117,878 | 6/1992 | Shaw et al. | 141/333 |
| 5,184,751 | 2/1993 | Middleton | 141/334 |
| 5,291,921 | 3/1994 | Devine | 141/332 |
| 5,373,961 | 12/1994 | Harris et al. | 220/571 |

*Primary Examiner*—Henry J. Recla
*Assistant Examiner*—Steven O. Douglas
*Attorney, Agent, or Firm*—Pearne, Gordon, McCoy & Granger LLP

[57] ABSTRACT

A drain funnel for drums having retaining pockets for the storage of closure caps for the pouring spout and vent opening of the drum. The funnel also is provided with a cover to permit the funnel to remain in place without the escape of fumes from the drum.

5 Claims, 4 Drawing Sheets

Fig.5
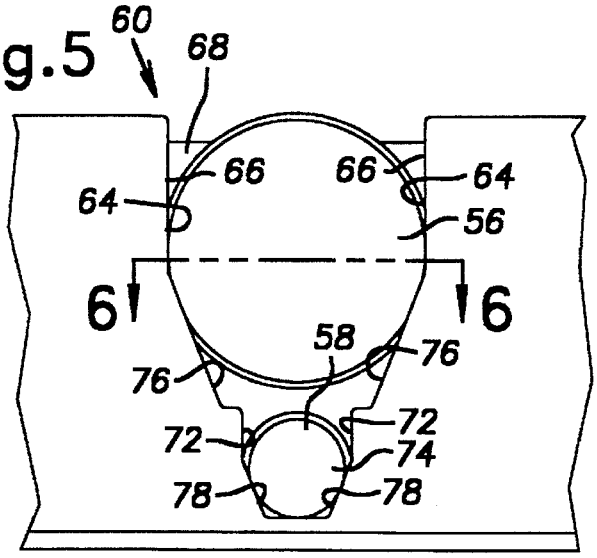
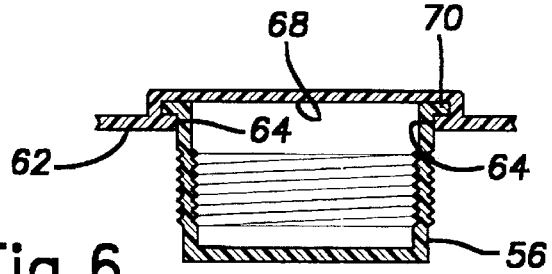
Fig.6
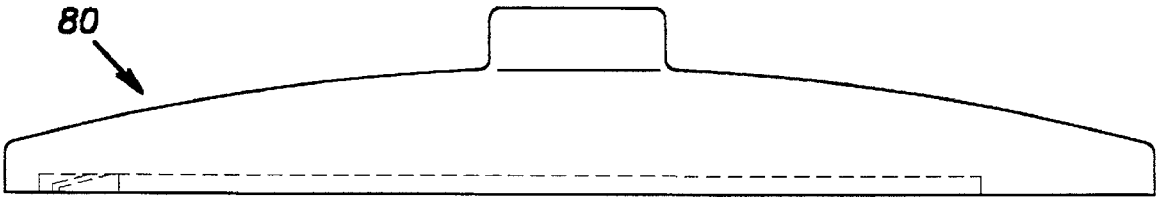
Fig.7

FUNNEL FOR A DRUM

BACKGROUND OF THE INVENTION

This invention relates generally to the field of funnel devices used to facilitate the pouring of a liquid into a small opening. More particularly, the invention relates to the field of self supporting funnels for use on barrels or drums.

It is often desirable to pour liquids into a large container or drum. The large containers are typically of a 55 gallon or 30 gallon size and have a small circular opening place off center of the lid for pouring or pumping fluids out of the container and a smaller off center circular opening for venting the container. A funnel device having a large receiving end is required to prevent spillage of the liquid being poured and to be sure that the liquid enters the opening in the barrel. Such devices are well known.

Further it is desirable to empty the contents of one partially filled container into another partially filled container so that the emptied container may be recycled.

It is also often necessary to drain objects containing liquid by inverting the object onto a drain field and allowing the liquid to flow downwardly. For example, used automotive oil filters are inverted and placed on a drain field so that the used oil is removed prior to disposal of the filter.

Further it is desireable to empty the contents of one partially filled container into another partially filled container so that the emptied container may be recycled.

It is also necessary to provide a funnel which is securely mounted on a container to ensure stability. Whether the funnel is mounted on a 55 gallon. U.S. Pat. No. 5,117,878 to Shaw et al. provides a drain field funnel which overcomes many prior art problems with respect to stability of the funnel on the container and the support of objects on the funnel for long periods of time during draining operations. This solution, however, creates a situation wherein the contents of the container and the articles on the drain field remain exposed to the atmosphere and may contaminate the atmosphere by such exposure. Furthermore the large closure cap and the smaller vent cap may be misplaced while the funnel is in place.

BRIEF DESCRIPTION OF THE INVENTION

This invention overcomes the problems associated with the improved funnel disclosed in the Shaw et al. patent. More particularly this invention provides a funnel which securely rests on differently sized containers while providing a more effective seal between the funnel and the container and which provides a closure cap for the entire drain surface of the funnel while articles are draining thereon. This invention also provides a convenient storage pocket for the closure and vent caps of the container. The invention also permits another container to be inverted onto the funnel for drainage onto the drain surface.

According to this invention the funnel comprises an upper face having a sloping drain surface and an opening located within the interior of the perimeter of the drain surface. The drain surface slopes downwardly toward the opening. A vertical rim extends upwardly a substantial distance from the perimeter of the drain surface and defines an upwardly opening pocket for receiving the closure cap and the vent cap for the container. A cap extends over the vertical rim and has a cylindrical wall which threadedly cooperates with the outside of the vertical rim. The funnel securely rests on the container and has a bottom surface which contacts the entire periphery of the container rim whether the container is a 55 gallon drum or a 30 gallon drum. In the case of a 55 gallon drum the funnel also has a depending cylindrical wall which snugly engages the outside periphery of the drum. In the case of a 30 gallon drum the funnel has a depending portion which securely fits against a substantial portion of an inside surface of the upper rim of the drum. A cap or cover is provided which seals the drain surface of the funnel.

DESCRIPTION OF THE DRAWINGS

FIG. 5 is an enlarged segmentary elevational view of the pocket which receives the closure and venting caps for the container; and FIG. 6 is a cross-sectional view, the plane of the section being indicated by the line 6—6 in FIG. 5; and FIG. 7 is an elevated view of a funnel cap which cooperates with the funnel illustrated in FIGS. 1 through 4.

DETAILED DESCRIPTION OF THE INVENTION

Figure 1:
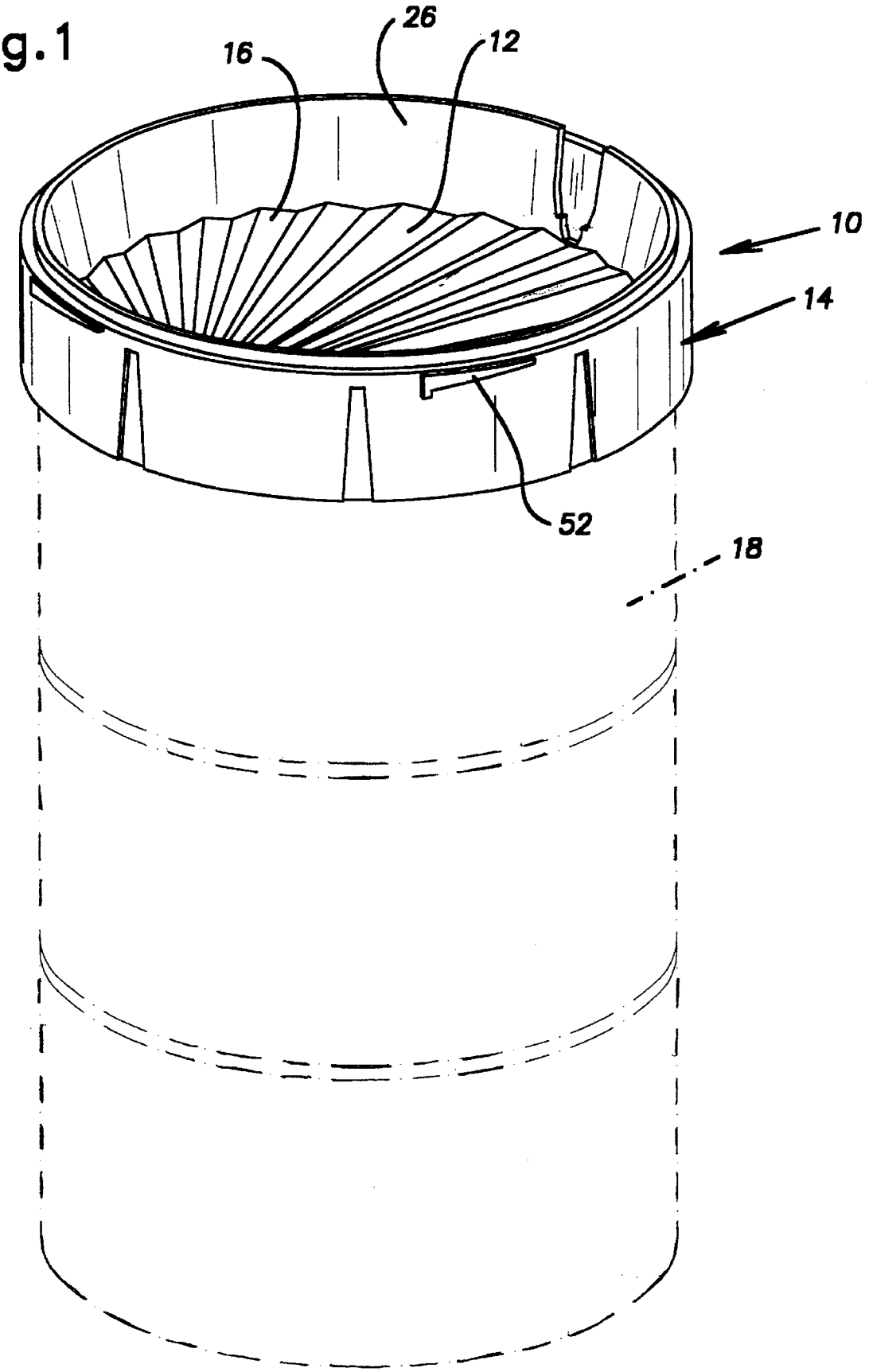
FIG. 1 is a perspective view of a funnel according to this invention illustrating the funnel positioned upon a 55 gallon drum.
Figure 2:
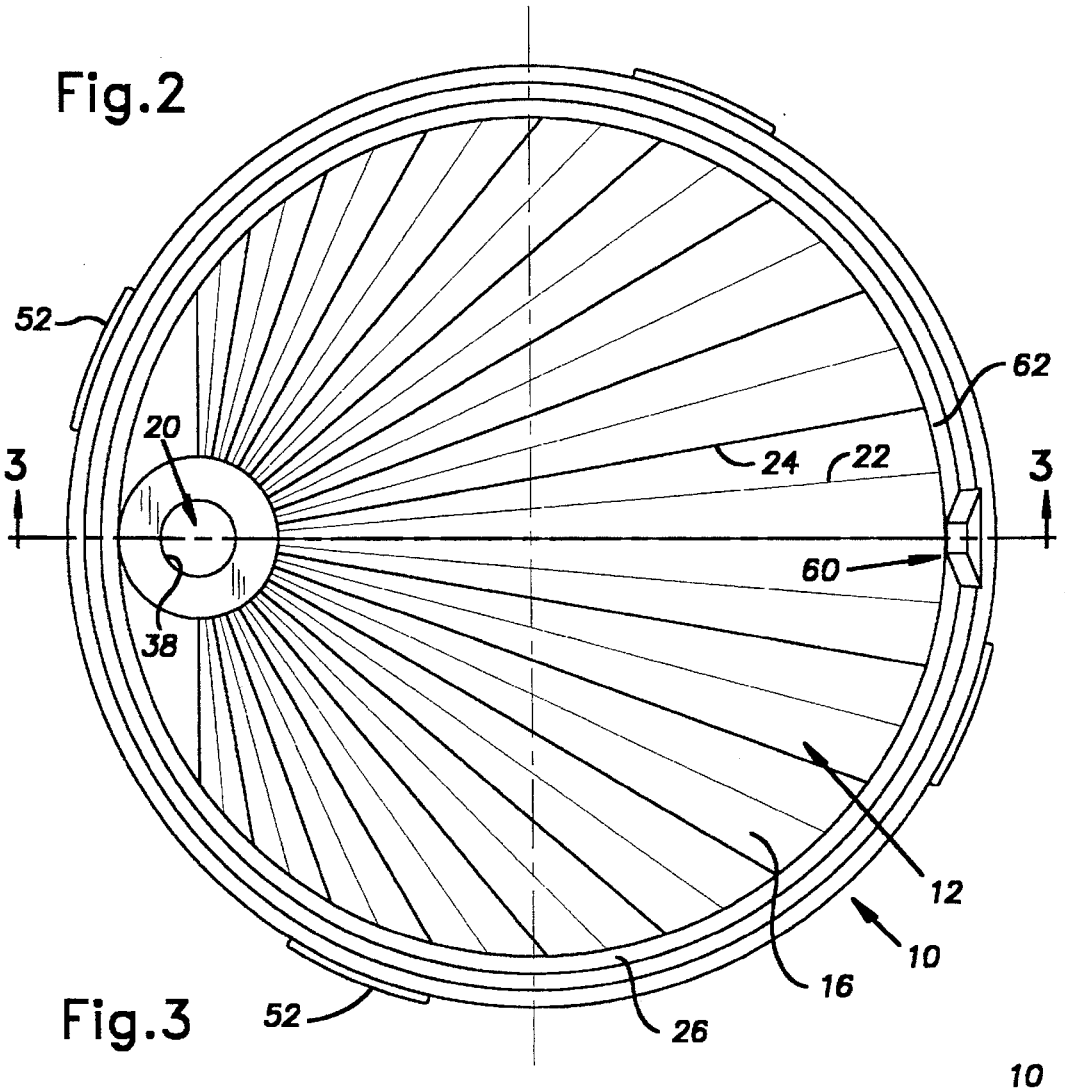
FIG. 2 is a top view of the funnel.
Figure 3:
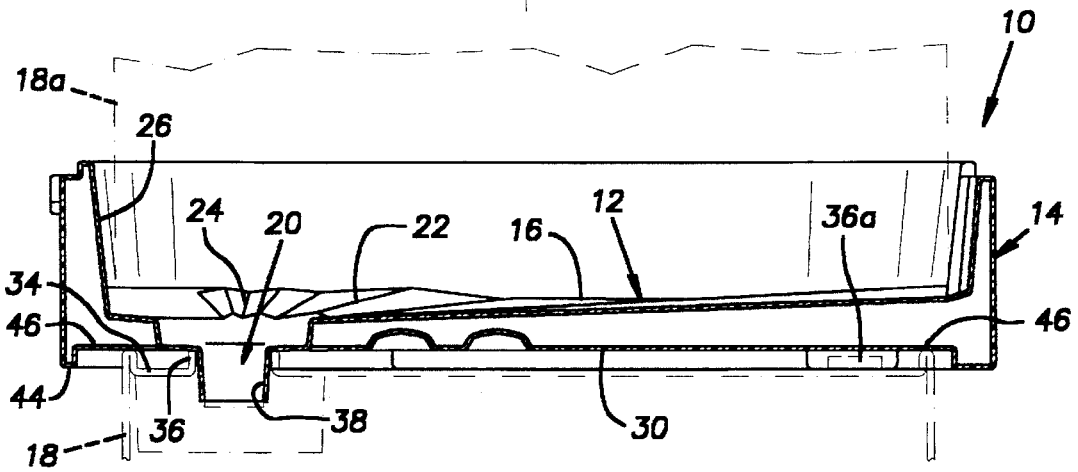
FIG. 3 is a cross-sectional view, the plane of the section being indicated by the line 3—3 in FIG. 2.

Referring now to the drawings a funnel 10 is illustrated as having a double wall construction consisting of an inner wall 12 and an outer wall 14. The double wall construction provides structural rigidity to the funnel and may be accomplished by known rotational casting or blow molding techniques. However it should be appreciated that the funnel according to this invention may be a single wall construction and may be fabricated by injection molding, transfer molding, or vacuum forming techniques. The inner wall 12 defines a sloping drain field surface 16 which is preferably circular with a diameter sufficient to match the diameter of a typical 55 gallon drum 18. For use with small drums, pails or buckets, the drain field surface 16 and the entire device may be down sized accordingly. As indicated in FIG. 3, the diameter of the drain field is sized so that another drum 18 may be inverted and placed on the funnel 10 to drain its contents onto the surface 16. The drain field surface 16 is substantially horizontal, but has a small downward 2 slope in the direction of a drain outlet 20. The slope according to a preferred aspect of this invention is less than about 5 degrees.

The slope of the drain field surface 16 causes liquids poured onto the surface to flow toward the outlet 20 without puddling on the drain field surface 16. Since the drain field surface 16 is relatively horizontal any objects placed on the surface for extended drainage will remain in place and will not slide into and block the outlet 20. While the surface 16 can be a relatively smooth surface, it is preferable to facilitate drainage by incorporating an uneven surface to maintain the draining objects a distance above the flow surface to enable the liquid to flow underneath the objects being passively drained without interference. This is accomplished by providing a series of ridges 22 and channels 24 radiating from the outlet 20 to form a scalloped or seashell pattern in the surface 16. Objects to be drained are set onto the surface 16 and the ridges 22 maintain the object in an elevated position allowing the liquid to easily flow from the object and down the channels 24 into the outlet 20. Other patterns can be substituted for the scalloped pattern to accomplish the same purpose of elevating the object and directing flow toward the outlet 20.

A substantially vertical rim having a retaining wall 26 extends upwardly from the perimeter of the surface 16. The wall 26 acts to prevent sudden overflow of any large liquid amounts quickly dumped onto the surface 16 retaining the liquid until it can all be drained through the outlet 20 into the drum 18.

Figure 4:
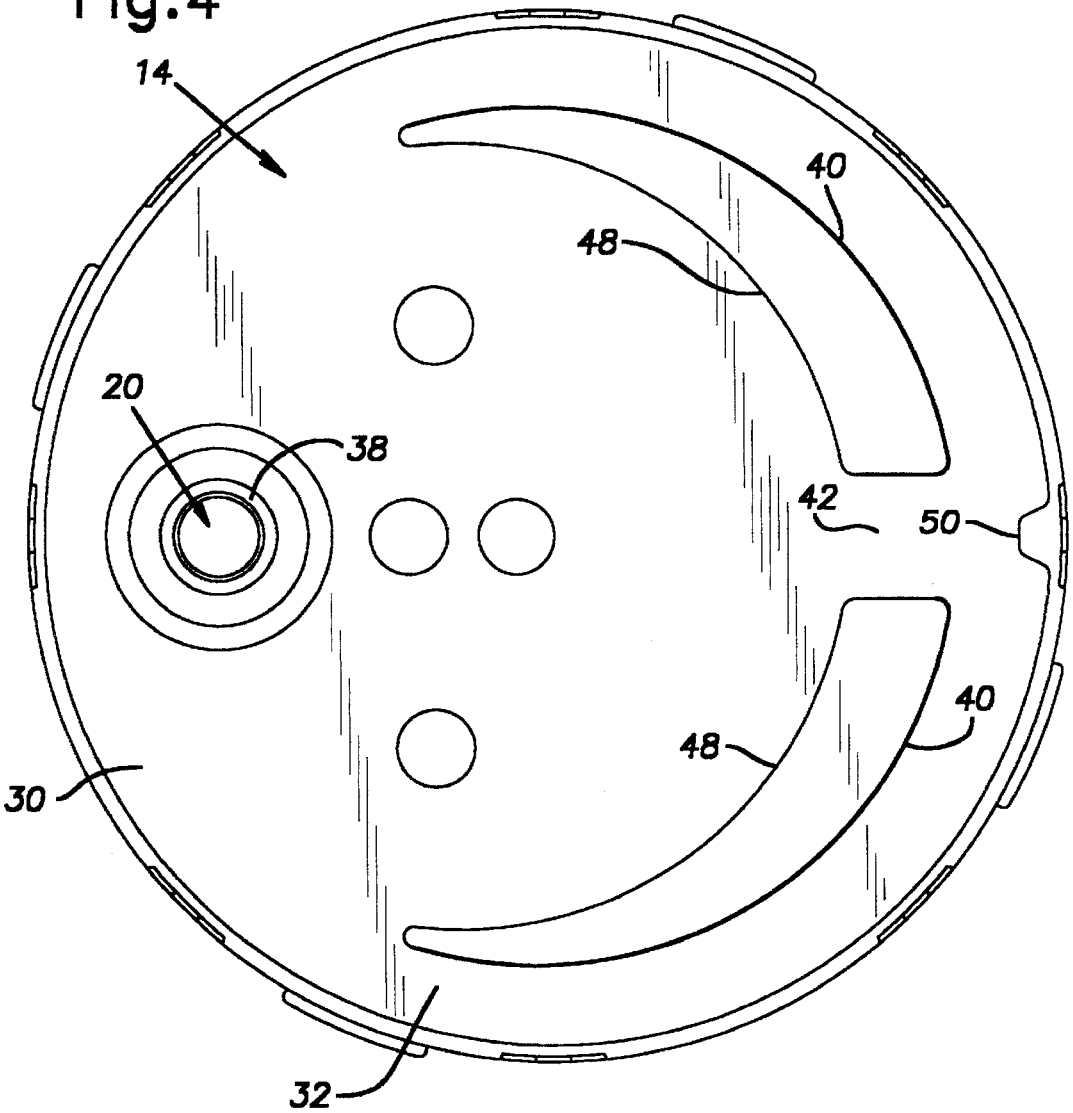
FIG. 4 is a bottom view of the funnel

The funnel 10 is adapted to rest on the top of a 55 gallon or 30 gallon size drum and is adapted to rest on either drum in a stable manner. Further the funnel 10 is adapted to minimize vapor leakage from the drum during periods of none use. Referring now it FIG. 3 and 4 the funnel has a bottom wall 30 which defines an annular seat 32 which may rest on that portion of a top wall 34 of the drum 18 which surrounds a threaded pouring spout 36 of the drum 18. The funnel has a drain spout 38 which extends into the open mouth of the pouring spout 36. The bottom wall 30 further defines crescent shaped ridges 40 which are adapted to rest on the surface 34 of the 55 gallon drum 18. A gap 42 is provided between the ridges 40 to accommodate a small vent spout 36*a*, typically provided on drums such as the drum 18. The bottom wall 30 also forms a ridge 44 which surrounds a top rim 46 of the drum 18 to minimize vapor leakage. A locating tab 50 is provided which serves to properly locate the drain spout 38 with respect to the pouring spout 36. Inner arcuate walls 48 defined by the ridges 40 are adapted to engage the outside surface of an upper rim of a 30 gallon drum. Thus the funnel 10 may be securely mounted on a 55 gallon drum or a 30 gallon drum with the nozzle extending into the pouring spout 38 and the ridge 44 surrounding the entire periphery of a 55 gallon drum or the wall 48 embracing a substantial portion of the periphery of a 30 gallon drum.

It may be noted that the funnel 10 is hollow and formed by double walls since, according to a preferred aspect of this invention, the funnel is rotationally cast. Therefor, the portions of the double wall illustrated in phantom outline in FIG. 3 are originally cast in the rotational casting mold but are removed during a later processing operation.

During periods of non use the funnel 10 may remain in position on the drum 18 and may be covered by a lid 80 which is threadedly fastened to discontinuous threads 52 provided on side walls 14 of the funnel 10.

Drums which are intended to contain liquids include a threaded pouring spout cap 56 (FIGS. 5 and 6) which is normally threaded over the pouring spout 36 and a smaller cap 58 which is normally threaded over the vent spout 36*a*. The vent spout 36*a* is positioned in a diametrically remote location with respect to the pouring spout 36. The caps 56 and 58 often become misplaced during times when the funnel is positioned on a drum. Therefor, as may be seen most clearly in FIG. 5 the funnel includes a closure cap retaining pocket 60. The pocket 60 is defined by an inner wall portion 62 of the retaining wall 26 and comprises a vertically extending gap in the wall 62 laterally defined by face-to-face gap edges 64. An upper pair 66 of the edges 64 are spaced apart a distance corresponding to the outside diameter of the closure cap 56. The wall 62 also defines a back wall 68 spaced radially outwardly from the inner face of the wall 62 and bridges the gap defined by the gap edges 64. The back wall 68 is spaced from the wall 62 a distance substantially corresponding to the thickness of a bead 70 on the cap 56.

The gap edges 64 further include a lower pair of parallel edge portions 72 which are spaced apart a distance less than the distance between the upper pair of parallel edge portions 66 and corresponding to the diameter of the vent cap 74. The gap edges 64 also include an upper pair of angularly related gap edges 76 which converge from and join the upper parallel gap edges 66 with the lower parallel gap edges 72 and includes a lower pair of angularly related gap edges 78 which converge from said lower parallel gap edges 72 toward the drain surface. The closure caps 56 and 74 are thereby nested between the upper parallel gap edges 66 and upon the upper angularly related gap edges 76 and the vent cap 74 is nested between the lower parallel gap edges 72 and upon the lower angularly related gap edges 78.

While the preferred embodiment of the present invention is shown and described herein, it is to be understood that the same is not so limited but shall cover and include all modifications thereof which fall into the purview of the invention.

What is claimed is:

1. A funnel, adapted for use in combination with drums having differently sized upper rims, said funnel comprising:

an upper face having a sloping drain surface having an outer perimeter and an opening located within the interior of said perimeter, said drain surface sloping downwardly from said perimeter to said opening;

a substantially vertical rim having a retaining wall extending upwardly from said perimeter of said drain surface, said wall defining an upwardly opening pocket for receiving a cup shaped closure cap for said drum, said pocket comprising a vertically extending gap in said retaining wall laterally defined by face-to-face gap edges, an upper pair of said edges being spaced apart a distance corresponding to the outside diameter of said closure cap.

2. A funnel according to claim 1 wherein said pocket further includes a back wall spaced radially outwardly from retaining wall and bridging said gap, said back wall being spaced from said retaining wall a distance substantially corresponding to the thickness of said bead.

3. A funnel according to claim 1 wherein said gap edges further include upper and a lower pair of parallel edge portions spaced apart a distance less than the distance between said upper pair and corresponding to the diameter of a vent cap for said drum.

4. A funnel according to claim 3 wherein said gap edges further include an upper pair of angularly related gap edges which converge from and join said upper parallel gap edges with said lower parallel edges, and include a lower pair of angularly related gap edges which converge from said lower parallel gap edges toward said drain surface, whereby said closure cap may be nested between said upper parallel gap edges and upon said upper angularly related gap edges and said vent cap may be nested between said lower parallel gap edges and upon said lower angularly related gap edges.

5. A funnel, according to claim 1 wherein said vertical rim includes an outside surface defining a first closure thread, a cap extending over said vertical rim and having a cylindrical wall defining a second closure thread cooperating with said first closure thread.

* * * * *